United States Patent [19]

Goetz

[11] Patent Number: 5,051,143

[45] Date of Patent: Sep. 24, 1991

[54] WATER BASED COATING FOR GAS GENERATING MATERIAL AND METHOD

[75] Inventor: George W. Goetz, Rochester Hills, Mich.

[73] Assignee: TRW Vehicle Safety Systems Inc., Lyndhurst, Ohio

[21] Appl. No.: 675,997

[22] Filed: Mar. 26, 1991

Related U.S. Application Data

[63] Continuation-in-part of Ser. No. 547,623, Jun. 28, 1990.

[51] Int. Cl.[5] ..... C06G 45/18

[52] U.S. Cl. ..... 149/3; 149/5; 149/35; 149/72; 149/110; 264/3.1; 264/3.4

[58] Field of Search ..... 149/3, 72, 5, 110, 35; 264/3, 3.4

[56] References Cited

U.S. PATENT DOCUMENTS

| | | | |
|---|---|---|---|
| 4,244,758 | 1/1981 | Garner et al. | 149/7 |
| 4,246,051 | 1/1981 | Garner et al. | 149/7 |
| 4,696,705 | 9/1987 | Hamilton | 149/21 |
| 4,698,107 | 10/1987 | Goetz et al. | 149/7 |
| 4,806,180 | 2/1989 | Goetz et al. | 149/5 |

*Primary Examiner*—Stephen J. Lechert, Jr.

*Attorney, Agent, or Firm*—Tarolli, Sundheim & Covell

[57] ABSTRACT

A gas generating grain has a water-based particulate booster coating thereon. The coating comprises an alkali metal azide, a water-soluble inorganic oxidizer in approximately a stoichiometric ratio of oxidizer to azide, and a nucleating amount of a small particle size metal oxide. The inorganic oxidizer is potassium perchlorate. A preferred metal oxide is selected from the group consisting of iron oxide, nickel oxide and aluminum oxide. The coating is applied to the grain from a water slurry and dried.

24 Claims, 1 Drawing Sheet

WATER BASED COATING FOR GAS GENERATING MATERIAL AND METHOD

BACKGROUND OF THE INVENTION

This application is a continuation-in-part of copending application Ser. No. 547,623, filed June 28, 1990, assigned to the assignee of the present application.

1. Technical Field

The present invention relates to gas generating material for an inflatable vehicle occupant restraint such as an airbag, and particularly to a booster coating for gas generating grains which, when ignited, produce gas for inflating the restraint.

2. Description of the Prior Art

It is known to provide a gas generating grain with a booster coating which enhances ignition of the grain. U.S. Pat. No. 4,806,180 discloses a booster coating comprising 30–50 percent by weight of a metal azide, 40–60 percent by weight of an inorganic oxidizer, 5–15 percent by weight of boron, and 1–15 percent by weight of an alkali metal silicate. Potassium perchlorate is disclosed as one suitable inorganic oxidizer. The boron produces heat to assist in igniting the grain to which the coating is applied. A preferred method of coating the grains involves first preparing a liquid coating mix in an appropriate container with a suitable solvent such as acetone or methyl alcohol. Water can also be used as the solvent. The grains are then placed in a steel mesh basket. The grains in the basket are immersed in the coating mix and then removed from the coating mix and dried.

A coating composition has also been proposed which is applied to the grain as a paste. The coating includes sodium nitrate and sodium azide. The sodium nitrate is first pulverized and then blended with sodium azide and a binder. Both the sodium azide and the sodium nitrate before blending are screened through a 100 mesh screen. Alcohol is added to form a paste. The gas generating grains are coated with the alcohol paste. A small amount of water is introduced as steam into the coating vessel. About 10 milliliters of water per fifty pounds of coating material is introduced into the coating vessel. This provides improved bonding of the coating to the grains. Following coating, the grains are placed in a 90° C. (194° F.) oven for overnight drying.

U.S. Pat. Nos. 4,696,705 and 4,698,107 disclose a coating composition for a nitrogen gas generating grain for a vehicle occupant restraint. The coating composition contains 10–15 percent by weight of a fluoroelastomer binder. The composition also contains 20–50 percent by weight of alkali metal azide, 25–35 percent by weight of inorganic oxidizer, 15–25 percent by weight of magnesium, and 1–3 percent by weight of fumed metal oxide. The ingredients are mixed with a suitable solvent and applied to the grain. The fumed metal oxide functions in the coating mix as a suspension agent and keeps the ingredients of the coating composition suspended in the mix so that a uniform coating is applied to the grain.

Coating compositions which are dissolved in an organic solvent for application to a gas generating grain are disclosed in U.S. Pat. Nos. 4,244,758 and 4,246,051. A problem with an organic solvent-based coating, such as an acetone-based coating, is that vapors from the solvent of the coating create a fire hazard and/or may be toxic.

SUMMARY OF THE INVENTION

The present invention resides in a gas generating grain which has a booster coating thereon. The booster coating comprises approximately a stoichiometric ratio of potassium perchlorate to alkali metal azide, and a nucleating amount of a small particle size metal oxide. Preferably, the metal oxide has an average particle size less than about 0.5 microns. A preferred metal oxide is selected from the group consisting of iron oxide, nickel oxide and aluminum oxide.

A preferred coating composition consists essentially of, on a dry weight basis:

| | |
|---|---|
| Sodium azide | 74.5% ± 3.5% |
| Potassium perchlorate | 24.25% ± 3.5% |
| Iron oxide | 0.75% ± 0.5% |
| Clay | 0.5% ± 0.5% |

The coating is applied to the gas generating grain as a water slurry and is rapidly dried. The coating, when dried, is in the form of a plurality of particulates adhered to the grain.

BRIEF DESCRIPTION OF THE DRAWINGS

The foregoing and other features of the present invention will become more apparent to one skilled in the art upon consideration of the following description, with reference to the accompanying drawings, in which.

DESCRIPTION OF A PREFERRED EMBODIMENT OF THE INVENTION

A body 10 (known as a "grain") of gas generating material is used in inflatable vehicle occupant restraint systems to inflate an occupant restraint, such as an airbag. The grain 10, or a plurality of grains 10, of gas generating material could be used in many different types of inflatable restraint systems. One inflatable restraint system in which the grains of gas generating material may be used is described in U.S. Pat. No. 4,817,828 issued Apr. 4, 1989 and entitled "Inflatable Restraint System".

The grain 10 of gas generating material includes a fuel which is a source of nitrogen gas and a oxidizer which reacts with the fuel. The grain 10 of gas generating material also contains an oxidizing agent, extruding aid and strengthening fibers. The preferred fuel or source of nitrogen gas is an alkali metal azide, such as sodium, potassium or lithium azide. Sodium azide is the most preferred alkali metal azide. The oxidizer is preferably a metal oxide. The metal of the metal oxide may be any metal lower in the electromotive series than the alkali metal. Examples of preferred metals are iron, copper, manganese, tin, titanium, or nickel, and combinations of such metals. The most preferred oxidizer is iron oxide.

The oxidizing agent in the grain 10 may be an alkali metal nitrate, chlorate, and/or perchlorate or combinations of the foregoing. At the present time, it is preferred to use sodium nitrate as the oxidizing agent. Relatively small amounts of an extrusion aid and strengthening fibers are provided in the grain 10. Bentonite is the preferred extrusion aid. Graphite fibers are preferably used as the strengthening fibers.

The grain 10 of gas generating material has the following proportions of ingredients by weight:

TABLE 1

| Ingredient | Amount | Range |
|---|---|---|
| Sodium azide ($NaN_3$) | 57.9% | ±10% |
| Iron oxide ($Fe_2O_3$) | 34.6% | ±10% |
| Graphite | 3% | 0 to 6% |
| Bentonite | 2.5% | 0 to 5% |
| Sodium Nitrate ($NaNO_3$) | 2% | 0 to 10% |

It should be understood that the composition of the grain 10 of gas generating material could be different than the specific composition set forth above. For example, an alkali metal azide other than sodium azide could be used. Also, a different oxidizer could be used. Although graphite fibers are preferred to provide mechanical reinforcement, other fibers could be used, such as glass fibers and iron fibers. Extrusion aids other than bentonite could be used, and/or oxidizing agents other than sodium nitrate could be used, such as potassium perchlorate. If desired, the composition of the grain of gas generating material could be the same as described in U.S. Pat. No. 4,806,180 issued Feb. 21, 1989 for "Gas Generating Material".

Figure 2:
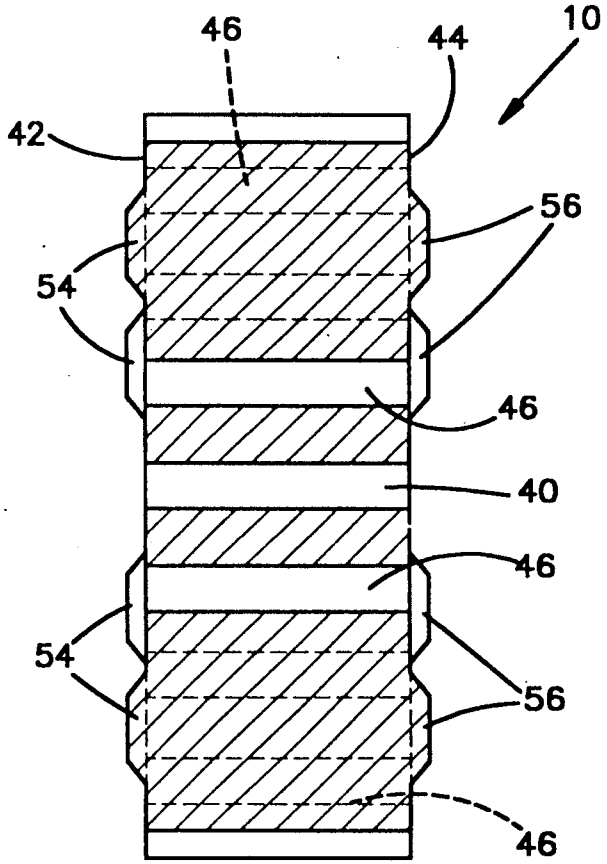
FIG. 2 is a sectional view, taken along the line 2—2 of FIG. 1, further illustrating the construction of the body of gas generating material.

The grain 10 (FIGS. 1 and 2) has a generally cylindrical shape and has a cylindrical central passage 40 with an axis disposed on the central axis of the grain. The passage 40 extends between axially opposite end faces 42, 44 (FIG. 2) of the grain. In addition, the grain 10 has a plurality of cylindrical passages 46 which are disposed radially outwardly relative to central passage 40 and which also extend longitudinally through the grain between the opposite end faces 42, 44.

Figure 1:
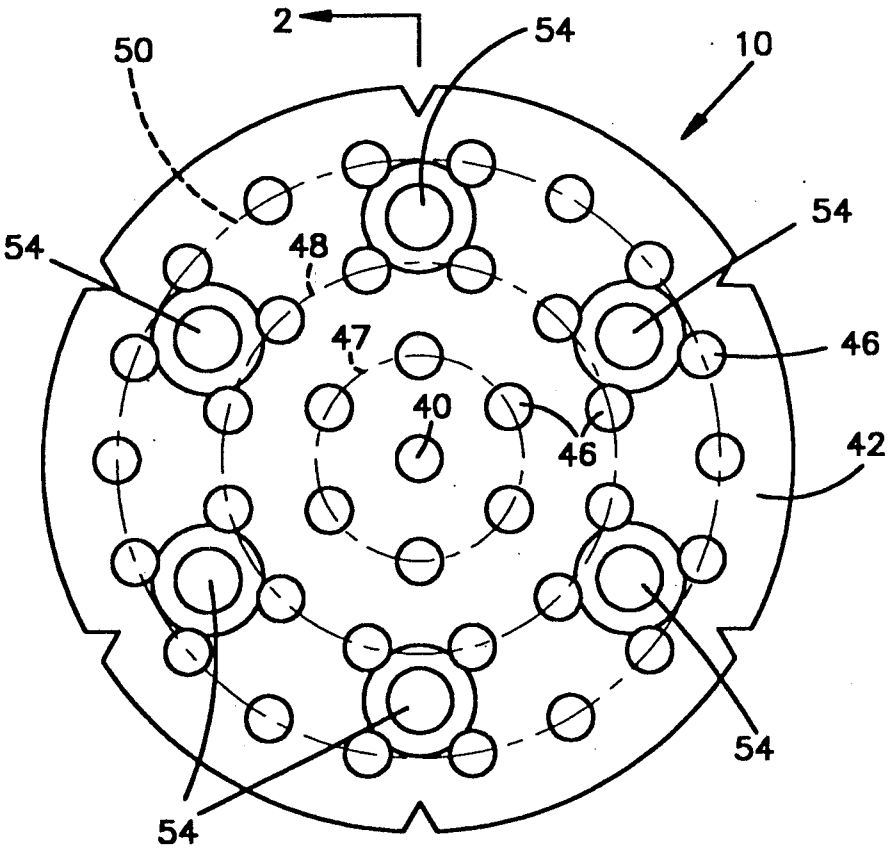
FIG. 1 is a plan view of a body of gas generating material used in a vehicle occupant restraint system.

The axes of the passages 46 are parallel to the axis of passage 40. The passages 46 are evenly spaced, on concentric circles 47, 48 and 50 which are radially spaced from passage 40, but co-axial with the axis of passage 40. As shown in FIG. 1, the axes of the passages 46 on one of the concentric circles are offset circumferentially, to one side, from the axes of the passages 46 on the other concentric circles. In this respect, a passage 46 on a first concentric circle is spaced from an offset passage on an adjacent concentric circle the same distance that it is spaced from an adjacent passage 46 on the first concentric circle.

When used to inflate an airbag, the plurality of grains 10 are stacked so that the passages in one grain are aligned with the passages in all of the other grains. Thus, hot gas flows through the passages to ignite the grains, and the surfaces of the passages of all of the bodies are quickly ignited.

The gas which is generated within the passages must be able to get out of the passages and flow radially of the grains into an airbag to inflate the airbag. To provide for such flow, spaces are provided between the end faces 42, 44 (FIG. 2) of adjacent grains 10. The spaces extend radially outward from the central passage 40 of the grains. The spaces between the ends of adjacent grains are provided by axially projecting standoff pads 54, 56 (FIG. 2) on the end faces 42, 44. As disclosed in prior U.S. Pat. No. 4,817,828, the standoff pads of one grain are aligned with those of an adjacent grain so that the spaces between the grains are provided by the combined height of the standoff pads of adjacent grains. Several standoff pads 42, 44 are positioned in circumferentially spaced apart relationship on each end face so as to maintain the end faces of adjacent grains in spaced apart parallel planes.

The plurality of passages 40, 46 in a grain 10 promote what has been referred to as a progressive rate of burn of a grain. A progressive rate of burn is one in which the burning proceeds, for a substantial part of the burn cycle, at a rate which increases. As the circumferential surfaces of the passages burn, the passages widen, exposing increasingly more surface area to burning. Simultaneously, the outer circumference of each grain 10 shrinks, reducing the surface area exposed to burning, but this reduction in surface area is less than the increase in surface area produced by burning in the passages in the grain. At a point in the burn cycle, the burn rate ceases to increase and remains constant until near the end of the burn cycle, at which time the rate of burn will decrease to zero.

The process for manufacturing the gas generating material is disclosed U.S. Pat. No. 4,994,212, issued Feb. 19, 1991. The gas generating material is formed by preparing a wet mixture of the metal azide and metal oxide. The wet mixture of the metal azide and metal oxide is prepared without prior mixing of the metal azide and metal oxide in dry form. By having the metal azide and metal oxide contact each other only when they are wet, the possibility of fire and/or explosion is minimized during the manufacturing process. During processing of the wet mixture of gas generating material, the mixture is repeatedly ground to reduce the particle size of one or more ingredients of the mixture. During the grinding of the wet mixture, the mixture is also cooled to maintain the temperature of the mixture in a desired temperature range of 20° C. to 30° C. Once the wet mixture of gas generating material has been formed, excess liquid is removed from the mixture, for instance, by centrifuging. Following partial drying, the wet mixture (cake) of gas generating material is extruded to form small cylindrical granules or pellets of the gas generating material. The cylindrical granules are preferably formed into spherical granules in a spheronizing process and then dried. The granules may then be stored for later use. The granules are removed from storage and pressed together to form the grains 10 of gas generating material shown in FIGS. 1 and 2.

Once the grains 10 of gas generating material have been formed by the pressing step, they are coated with an ignition enhancing booster material. Specifically, a coating slurry is applied to the surface of a grain. In accordance with the present invention, the coating slurry comprises water, a water soluble alkali metal azide, a water soluble inorganic oxidizer which is reactive with the azide, and a metal oxide. The water soluble inorganic oxidizer is potassium perchlorate. A preferred alkali metal azide is sodium azide. Other azides such as potassium azide and lithium azide can be used. A preferred metal oxide is iron oxide ($Fe_2O_3$). Other metal oxides such as nickel oxide and aluminum oxide can also be used.

The potassium perchlorate is commercially available in an average particle size of about thirty (30) microns. The potassium perchlorate is preferably dry milled to an average particle size of about ten (10) microns. The sodium azide is commercially available in an average particle size of about 80–100 microns. The iron oxide is commercially available in an average particle size of about 0.2 microns.

The coating ingredients are added as solids to the water to form the water slurry. The amount of water in the slurry is enough to make the slurry fluid. The amount of water is insufficient to dissolve all of the azide and perchlorate, so that some of both ingredients will be in the solution phase of the slurry and some of both ingredients will make up the solids phase of the slurry. Preferably, the amount of water is about 20-30% based on the weight of the slurry. A preferred weight ratio of water to solids is about 25% water to about 75% solids.

The grains are coated with the coating slurry in any conventional coating process. A preferred method is to place the grains on a traveling grate, and pass the grains through a spray curtain of the water slurry. The grains are then passed through air jets to blow excess coating from the grains. Another method is to place the grains in a coating basket and immerse the grains into the coating slurry.

Following coating, the grains are placed in an oven and dried. Drying can be carried out in a single step using a jet oven dryer operated at about 126°-132° C. (260°-270° F.) for about two hours. Alternatively, the drying can be carried out in multiple steps, for instance, by using an air-jet dryer for initial drying followed by steam drying for final drying.

The grains prior to coating have a moisture content of about 2% to 3.5% by weight. After coating and prior to drying, the grains and coating combined have a total moisture content of about 7% by weight. Drying reduces the total moisture content of the grains and coating to about 5.4%.

During drying, the coating forms on the grains as small particulates. The depth of the coating may be about 1/10th to 2/10ths of a millimeter. The particulates of the coating have a small size, for instance, less than about 50 microns (about 0.5 mm) average particle size. The weight of the coating particulates on a grain, on a dry basis, is about 5%-6% based on the grain weight.

The ratio of potassium perchlorate to alkali metal azide, e.g., sodium azide, which is used in preparing the coating slurry, is at least a stoichiometric ratio of perchlorate to azide, which is required to react all of the sodium azide to sodium oxide on ignition of the coating. The reaction of sodium azide with potassium perchlorate is embodied in the following equation:

$$KClO_4 + 8NaN_3 \rightarrow KCl + 4Na_2O + 12N_2$$

It is apparent from the above equation that the stoichiometric ratio of perchlorate to azide is 1:8. Preferably, the ratio of moles of potassium perchlorate to moles of sodium azide used in preparing the coating slurry is slightly in excess of the stoichiometric ratio. The reason for this is that the coating, following drying, could have zones in which there is too little potassium perchlorate. This could result, on combustion, in the formation of some free sodium. To assure that the coating throughout has sufficient potassium perchlorate so that all of the sodium reacts to sodium oxide, a mole ratio of about 105:800, potassium perchlorate to sodium azide, preferably is used.

A mole ratio of 105:800 provides, on a weight basis, based on the dry weight of the coating composition, about 24.25% potassium perchlorate and about 74.5% sodium azide. Preferably, the coating slurry of the present invention comprises, on a dry weight basis, about 24.25%±3.5% potassium perchlorate and about 74.5%±3.5% sodium azide.

A primary advantage of the coating composition of the present invention is that a homogeneous coating is readily obtained using potassium perchlorate as the oxidizer. This is, to a large extent, due to the solubility of potassium perchlorate in water. Both potassium perchlorate and sodium azide are only partially water soluble. The following Table 2 provides approximate solubility data for potassium perchlorate and sodium azide.

TABLE 2

| Ingredient | Water Solubility at 25° C. gms/100 cc's | Water Solubility at 100° C. gms/100 cc's |
|---|---|---|
| KC104 | 3 | 21.8 |
| NaN3 | 30 | 35.5 |

During drying of the coating, the coating increases in temperature from about room temperature (about 25° C.) to about 100° C. The above Table 2 shows that the solubility of sodium azide is relatively insensitive to temperature changes. In contrast, the solubility of potassium perchlorate changes substantially from 25° C. to 100° C. Thus, if the slurry contains a stoichiometric ratio of perchlorate to azide, the solution phase of the slurry has less than a stoichiometric ratio (in terms of moles of potassium perchlorate) at 25° C., and more than a stoichiometric ratio at 100° C. The solids phase has just the opposite, more than a stoichiometric ratio at 25° C., and less than a stoichiometric ratio at 100° C. Most of the drying takes place at about 65° C. At this temperature, it was found that the mole ratio of perchlorate to azide fortuitously was about the same in the solution phase as in the solids phase, and at about the stoichiometric ratio. The result is that all of the coating particles have, on drying, about the same composition, resulting in a more uniform or homogeneous coating on the grains.

It was mentioned above that the potassium perchlorate preferably is milled to an average particle size of about 10 microns. This provides a wide range of particle sizes in the slurry, ranging from about 80-100 microns for the azide to less than about 0.5 microns for the iron oxide. This wide range of particle sizes facilitates control of the coating viscosity. The coating viscosity is important since it affects the amount of coating retained on a grain when excess coating is blown from the grain.

The water-insoluble metal oxide is an important ingredient of the present invention. A preferred metal oxide is iron oxide. Other oxides such as nickel oxide and aluminum oxide can also be used. The metal oxide should have a very small particle size, preferably less than about 0.5 micron average particle size, e.g., about 0.2 micron average particle size. Only a small amount of metal oxide is required. The metal oxide functions in the coating composition of the present invention as a nucleating agent to promote the growth of small crystals and inhibit the growth of large crystals in the drying step, which follows application of the coating slurry to the gas generating grains. Thus, a preferred amount of metal oxide is a nucleating amount. Broadly, the amount of metal oxide is about 0.25-1.25% based on the weight of the coating, absent water. A preferred amount of iron oxide is about 0.75% based on the weight of the coating. Small crystals in the coating adhere better to the gas generating grains. Smaller crystals also burn more rapidly, reducing the ignition time of the gas generating composition. Preferably, the coating has an average particle size following drying of less than about 50 microns. The metal oxide is also a reactant with the azide, on ignition of the coating composition.

Other ingredients can be added to the coating composition of the present invention. For instance, the coating composition can contain a small amount of clay (e.g., bentonite) which functions as a binder in the coating composition. The amount of clay used is small, for instance, from zero up to about 1% based on the total dry weight of the coating composition.

A preferred coating slurry comprises (minus water):

TABLE 3

| Ingredient | Weight Percentage |
|---|---|
| Potassium Perchlorate | 24.25% ± 3.5% |
| Sodium Azide | 74.5% ± 3.5% |
| Iron Oxide | 0.75% ± 0.5% |
| Clay | 0.5% ± 0.5% |

The following Example illustrates the practice of the present invention.

EXAMPLE

In this Example, a 75/25 ratio, by weight solids/water slurry was prepared using the composition of Table 3. The potassium perchlorate was stirred into the water, at room temperature. The iron oxide was then added. The azide was blended into the perchlorate solution. The slurry was maintained at a pH of about 9–10, by the addition of sodium hydroxide, if necessary. The slurry was pink in color and had the consistency of heavy cream. The slurry was continuously recirculated through a colloid mill to obtain a uniform mixture. The gap setting in the colloid mill was large enough so that no comminution of particles occurred. Gas generating grains to be coated were placed on a travelling grate and passed under a curtain of slurry gravity fed onto the grains. The gas generating grains had a composition similar to that of Table 1. The grains had a moisture content of about 2% to 3.5% by weight and preferably about 3% by weight. The rate of travel of the grate was adjusted to expose the grains to the curtain of slurry for about three seconds. The coated grains were then passed under a curtain of air, to remove excess coating slurry. After a few seconds under the curtain of air, the grains were placed in a tray for batch drying. Drying was carried out in an oven at about 126° C. with high speed air circulation, for about two hours. The coating had a uniform composition throughout. The weight of the coating was about 5.5%±0.5%, based on the weight of the grains.

The coating of the present invention adhered well to the gas generating grains, and ignition of a gas generating grain by the coating was robust. The weight of the coating on a grain can range plus or minus 10% with little discernable effect on ignition across an ignition temperature range to which the coating may be exposed. These ignition characteristics were obtained even though the coating composition had no metallic fuel component, such as boron.

From the above description of a preferred embodiment of tho invention those skilled in the art will perceive improvements, changes and modifications. Such improvements, changes and modifications to those skilled in the art are intended to be covered by the pending claims.

Having described a specific preferred embodiment of the invention, I claim:

1. A gas generating grain having a particulate booster coating thereon, said coating comprising an alkali metal azide, a water-soluble inorganic oxidizer, said oxidizer being potassium perchlorate, and a water-insoluble metal oxide, said coating being applied to said grain as a slurry and dried.

2. The grain of claim 1 wherein the ratio of oxidizer to azide is approximately a stoichiometric ratio.

3. The grain of claim 2 wherein said alkali metal azide is sodium azide and said coating comprises, on a weight basis, about 74.5%±3.5% sodium azide and about 24.25%±3.5% potassium perchlorate.

4. The grain of claim 3 wherein said metal oxide is present in a nucleating amount.

5. The grain of claim 4 wherein said metal oxide has an average particle size less than about 0.5 micron.

6. The grain of claim 5 wherein said metal oxide is iron oxide, said coating comprising about 0.75%±0.5% by weight iron oxide.

7. The grain of claim 6 wherein said iron oxide has an average particle size of about 0.2 micron.

8. The grain of claim 1 comprising about 5–6% by weight coating, based on the weight of the grain.

9. The grain of claim 1 wherein said coating is applied to said grain from a water-based slurry, the mole ratio of perchlorate to alkali metal azide in said slurry being about 105% of the stoichiometric ratio of perchlorate to azide.

10. The grain of claim 9 having a moisture content of about 3% prior to coating.

11. The grain of claim 9 wherein said slurry comprises about 20%–30% by weight water and about 80%–70% by weight solids.

12. The grain of claim 9 oven dried following coating at a temperature of at least about 126° C.

13. The grain of claim 1 wherein said coating consists essentially of, on a dry weight basis;

about 24.25%±3.5% potassium perchlorate;
about 74.5%±3.5% alkali metal azide;
about 0.75%±0.5% iron oxide; and
about 0.5%±0.5% clay.

14. A gas generating grain having a particulate booster coating thereon, said coating being free of a metal fuel and comprising an alkali metal azide, a water-soluble inorganic oxidizer in approximately a stoichiometric ratio of oxidizer to azide, said oxidizer being potassium perchlorate, and a nucleating amount of a water-insoluble metal oxide, said coating being applied to said grain as a water slurry and dried.

15. A method for making a gas generating grain having a booster coating thereon, comprising the steps of:

(a) preparing said grain;
(b) preparing a coating slurry comprising water, an alkali metal azide, a water soluble inorganic oxidizer in approximately a stoichiometric ratio of oxidizer to azide, said oxidizer being potassium perchlorate, and a water-insoluble metal oxide;
(c) applying said coating slurry to said grain,
(d) removing excess coating slurry from said grain, and
(e) drying said grain and the coating thereon.

16. The method of claim 15 wherein said grain and coating thereon are dried at a temperature in excess of about 126° C.

17. The method of claim 16 wherein said metal oxide is a small particle size oxide present in a nucleating amount.

18. The method of claim 17 wherein said metal oxide is iron oxide having a particle size of about 0.2 micron.

19. The method of claim 15 wherein the mole ratio of inorganic oxidizer to azide in said slurry is slightly in excess of a stoichiometric ratio of oxidizer to azide.

20. The method of claim 19 wherein said mole ratio is about 105% of the stoichiometric ratio of oxidizer to azide.

21. The method of claim 15 wherein said potassium perchlorate is comminuted to a particle size of about 10 microns.

22. The method of claim 21 wherein said potassium perchlorate is comminuted prior to preparing said slurry.

23. The method of claim 15 wherein the weight ratio of solids to water is about 75/25.

24. A coated grain made by the method of claim 15.

* * * * *